US008083273B2

(12) United States Patent
Yuan

(10) Patent No.: US 8,083,273 B2
(45) Date of Patent: Dec. 27, 2011

(54) LOCK WITH A SWING BOLT AND AN ACTUATOR ASSEMBLY THEREOF

(75) Inventor: Mengxiao Yuan, Shanghai (CN)

(73) Assignee: Shanghai Buddy Technological Co., Ltd., Shanghai (CN)

( * ) Notice: Subject to any disclaimer, the term of this patent is extended or adjusted under 35 U.S.C. 154(b) by 0 days.

(21) Appl. No.: 12/830,022

(22) Filed: Jul. 2, 2010

(65) Prior Publication Data

US 2010/0270816 A1 Oct. 28, 2010

Related U.S. Application Data

(62) Division of application No. 12/012,812, filed on Feb. 6, 2008, now Pat. No. 7,770,944.

(30) Foreign Application Priority Data

Jun. 11, 2007 (CN) ..... 2007 1 0041833

(51) Int. Cl.
*E05C 3/06* (2006.01)

(52) U.S. Cl. ..... 292/201; 292/197

(58) Field of Classification Search ..... 292/201, 292/63–65, 197, DIG. 53, 341.16; 74/89.37, 74/89.32, 424.94, 425, 424.95
See application file for complete search history.

(56) References Cited

U.S. PATENT DOCUMENTS

| | | | | |
|---|---|---|---|---|
| 512,593 | A | 1/1894 | Webster et al. | |
| 2,276,740 | A * | 3/1942 | Saito | 200/47 |
| 2,890,475 | A | 6/1959 | Carlson | |
| 2,944,436 | A * | 7/1960 | Pickles | 74/89.37 |
| 4,192,398 | A * | 3/1980 | Hunt | 180/178 |
| 5,079,964 | A * | 1/1992 | Hamada et al. | 74/89.25 |
| 5,134,870 | A | 8/1992 | Uyeda et al. | |
| 5,142,890 | A | 9/1992 | Uyeda et al. | |
| 5,765,883 | A | 6/1998 | Dessenberger et al. | |
| 5,979,199 | A * | 11/1999 | Elpern et al. | 70/279.1 |
| 6,513,841 | B1 | 2/2003 | Jackson | |
| 6,786,519 | B2 | 9/2004 | Gartner | |
| 6,807,877 | B2 * | 10/2004 | Sato et al. | 74/89.37 |
| 7,261,335 | B2 | 8/2007 | Schupp | |
| 7,461,872 | B2 | 12/2008 | Moon et al. | |

* cited by examiner

*Primary Examiner* — Carlos Lugo
*Assistant Examiner* — Mark Williams
(74) *Attorney, Agent, or Firm* — Hamre, Schumann, Mueller & Larson, P.C.

(57) ABSTRACT

A lock with a swing bolt, comprises: a housing having an opening for a bolt; a cover which is complementary to the housing; a bolt movable between a locked position and an un-locked position through the opening; a controllable locking means to prevent the movement of the bolt to the unlocked position; wherein the locking means including: a block member, which is placed in a first sliding chute formed in the housing with a slidable fit between the block member and the first sliding chute; an actuator assembly having a follower which is placed in a second sliding chute formed in the housing with a slidable fit between the follower and the second sliding chute; one end of the block member being engaged with the bolt in a surface contact, the other end of the block member is engaged with the follower in a surface contact.

4 Claims, 5 Drawing Sheets

LOCK WITH A SWING BOLT AND AN ACTUATOR ASSEMBLY THEREOF

PRIORITY INFORMATION

This application is a Divisional Application of U.S. application Ser. No. 12/012,812 filed Feb. 6, 2008 entitled A LOCK WITH A SWING BOLT AND AN ACTUATOR ASSEMBLY THEREOF, which is hereby incorporated by reference in its entirety.

FIELD OF THE INVENTION

This invention relates to a lock, particularly to a lock with swing bolt.

BACKGROUND ART

In the prior art, in a lock for controlling a door of a safe, the body of the lock generally employs a straight-in/straight-out and square-shaped bolt or a wedge-shaped bolt. In a normal condition (locked-up condition), the bolt is restricted to be un-retracted, and it imposes a clog against a doorknob or door-release. In order to release the bolt from being restricted, a correct code should be input into the code entry device of the safe and be confirmed by a preset program in the device, and then an actuator assembly will act on to allow the lock to be unlocked. The bolt is reset to its normal condition (locked-up condition) by means of a return spring.

U.S. Pat. Nos. 5,142,890, 5,134,870 and 6,786,519 disclose several technical solutions of locks with swing bolts. In those solutions, a bolt is D-shaped (i.e., semicircular or a 180-degree sector), and a tension spring which is provided between the inside wall of a housing and the bolt is used as a return spring which forces the bolt from a turned-in position (unlocked position) to a turned-out position (locked-up position). The bolt can be locked up by a controllable solenoid, a head of an operating element (iron core) of the solenoid projects out and imposes directly a clog against a notch formed on the bolt.

In the above technical solutions, there are the following shortcomings.

If a lock is to be illegally and forcibly unlocked, a strong external force will be directly transferred to the bolt through the doorknob or door-release, and then directly transferred to the bolt through the doorknob or door-release, and then the bolt will transfer the force to the head of the operating element (iron core) of the solenoid. A linear contact between the bolt and the head of the operating element will bring about a stress concentration, and this trends to cause some damage of both the operating element and the solenoid.

The D-shaped bolt is larger in dimension, the return spring mated to it, accordingly, requires a larger extension/retraction space. Because both of them occupy a larger space in the lock body, the volume available in the lock body becomes smaller and so it is very difficult to add other functional elements in the lock body.

Moreover, in the lock of the prior art for controlling a safe door, there exist the following problems with their actuator assembly. If a one-directional solenoid is used (returned by a spring), such a solenoid causes a larger power consumption, this is especially disadvantageous for a safe's lock which uses a dry battery for power supply; if a bi-directional solenoid is used, apart from complication, it requires a even larger mounting space.

In the designs that employ a motor and a mechanism which transforms a rotational movement into a linear movement as well as a screw-and-nut mechanism, because of being limited by a small space in the lock body, a small-sized high-speed motor is generally used, and so is a small-sized screw-and-nut mechanism. As such, in the case of rotating at a high speed, it is very difficult for the screw to engage with the nut exactly, which trends to cause a jam between the screw and the nut so as to further bring about damages of the screw-and-nut mechanism or the motor.

SUMMARY OF THE INVENTION

The object of the present invention is to provide a lock with a swing bolt which is capable of protecting an actuator assembly from being damaged by an illegal and violent unlocking action and capable of dividing an illegal and violent force into components to act on several portions, and to provide an actuator assembly which is easy to reach an engagement between a male threaded member and a female threaded member and to protect a motor from being forcibly stopped.

The object of the present invention is achieved by a lock with a swing bolt comprising: a housing having an opening for a bolt; a cover which is complementary to the housing; a bolt movable between a locked position and an un-locked position through the opening; a controllable locking means to prevent the movement of the bolt to the un-locked position; wherein the locking means including: a block member, which is placed in a first sliding chute formed in the housing with a slidable fit between the block member and the first sliding chute; an actuator assembly having a follower which is placed in a second sliding chute formed in the housing with a slidable fit between the follower and the second sliding chute; one end of the block member being engaged with the bolt in a surface contact, the other end of the block member is engaged with the follower in a surface contact.

Preferably, the block member includes a stub which is placed in the first sliding chute, when the bolt is at the locked position, a first side of the stub is in a surface contact with a first side of the bolt, a second side of the stub is in a surface contact with a first side of a head of the follower, and a second side and a third side of the head of the follower are both in a surface contact with a complementary surface of the second sliding chute. The block member is formed with a recess, and the bolt is provided with a cylindrical protuberance which is in a position corresponding to the recess and is complementary to the recess.

When the actuator assembly is given an unlocking command, it makes the follower move in the retracting direction so as to make the second sliding chute vacant and thus allowing the stub to go partially into a space. The bolt can be turned into the unlocked position by an external force exerted by a user, meanwhile, the force is transferred to the first side of the stub so as to force the stub to go partially into the vacant space of the second sliding chute thereby the bolt can be turned into the unlocked position. At the moment the external force is withdrawn, the bolt is reset from the unlocked position to the locked position by a return spring, at the same time, the cylindrical protuberance on the bolt goes into the recess so as to make the block member to be reset.

Preferably, the bolt is a sectorial plate with a sector angle of 90-110 degree, on the bolt is provided a hole which is complementary to a pivot provided on the housing and with a slidable fit between the hole and the pivot. When a second side of the bolt is exerted with an external force, the first side of the bolt transfers the force to the first side on the stub of the block member via a surface contact.

Furthermore, on the housing and the cover, in a position corresponding to the bolt, there are formed a first guide rail and a second guide rail respectively, and on the cover is formed a cylindrical chamber which is complementary to the pivot so as to position and guide the bolt.

Preferably, the stub formed on the block member is a partial hollow cylinder, and the first sliding chute formed on the housing is composed of a convex semi-cylindrical surface and a concave partially-cylindrical surface, both of which are concentric and slidably fitted to the hollow cylinder. The first side of the stub withstands an external force which is transferred to it via its surface contact with the first side of the bolt, and the external force is transferred to the head of the follower via a surface contact between the second side of the stub and the head, and further, the external force is transferred to the housing via the contact between a second side and a third side of the head as one party and the second sliding chute as the other party. The block member includes a cylindrical portion formed integrally with the partial hollow cylindrical stub, the recess formed in the hollow cylindrical portion is a sectorial recess with an arc side opening, and the cylindrical protuberance provided on the bolt and corresponding to the recess is cylindrical-shaped.

Moreover, on the cover is formed a cylindrical chamber which is used as a boss hole for the cylindrical portion of the block member to be inserted into it with a slidable fit therebetween so as to further position and guide the block member.

Preferably, it further comprises an elastic element for moving the bolt from the unlocked position to the locked position. The elastic element is a torsion biasing spring, a first turns of which is placed over a pivot on the housing and a second turns of which is placed over a pin on the housing and near to the pivot, and a free end of which is caught in a notch formed in the bolt so as to exert a biasing force onto the bolt to force the same to the locked position.

The invention further provides an actuator assembly for a lock with a swing bolt, comprising: a motor; a leading screw which is connected coaxially to the motor; and a follower which is connected to the leading screw and moves linearly as the motor rotates. The follower includes a solid polyhedral head, and the head is placed and moved in a second sliding chute in the housing with a slidable fit so as to make the follower engage with the block member and the housing in surface contacts.

Preferably, the follower further includes a box, and the head is a portion of the box, and when the follower is in an extended position, a first side of the head is engaged with the first side of the stub of the block member in a surface contact, a second side and a third side of the head are engaged respectively with the corresponding surfaces in the second sliding chute in a surface contact; in the internal space of the box is provided a sleeve which is engaged with the leading screw and moves linearly as the leading screw is rotated and so as to move the box.

Furthermore, an internal hole of the sleeve is slidably fitted to the outside diameter of the leading screw. In the sleeve, perpendicularly to the internal hole, are provided two small holes and, which are for the two legs and of a clip to be inserted thereinto. With the clip being inserted into the holes and, the two legs and are caught in the corresponding threads of the leading screw, thereby as the leading screw is rotated, the clip and the sleeve move linearly so as to move the box.

Preferably, over the extended cylindrical end portions of the sleeve are placed respectively a first spring and a second spring, one end of the first spring is abutted against an internal end face of the box, and the other end of the first spring is abutted against a central projection of the sleeve, one end of the second spring is abutted on the other internal end face of the box, and the other end of the second spring is also abutted against the central projection of the sleeve.

In the present invention, on the housing are formed two cylindrical pins and for fixing a sensitive switch, and the switch can be touched by the bolt so as to detect whether the bolt is in the locked position or in the unlocked position. In the housing are also integrally formed pins, and for mounting a PCB of the control device and notches and for mounting electric connectors.

Preferably, on the housing and the cover, there are provided with mounting holes and respectively for mounting the lock onto a door. The mounting holes are all preferably provided with a counterbore. This makes it possible to mount the lock onto a door with its front side or with its back side against the door.

In comparison with the existing locks of the same type, the lock with a swing bolt of the present invention has the following advantages:

1. It employs a block member and a slidably turned structure. When the lock is exerted with an external force, the external force is withstood in a surface contact and is transferred to the housing in a surface contact. An elastic coupling is provided between the follower of the actuator assembly, which withstands and transfers an external force, and the motor shaft or leading screw of the actuator assembly, therefore, it is possible to protect the actuator assembly from being damaged by a violent external force.

2. An acting external force is transferred to the block member through the bolt and further to the solid follower head of the actuator assembly through the block member and even further to the housing. During the transmission, the external force is divided into at least two components in different directions, this is favorable to reduce stress concentration and thereby improving safety performance of the lock.

3. The surface dimensions of the bolt are reduced by using a torsion biasing spring, instead of a tension spring, which otherwise needs a larger space.

4. In the actuator assembly, the sleeve is provided with a clip which is engaged with the threads of the leading screw, and each end portion of the sleeve is provided with a guiding and damping spring, this is favorable to prevent the leading screw from being jammed and thus to protect the motor from being stopped.

5. PCBs, connectors, sensitive switches and so on are all assembled in the lock body defined by the housing and the cover, this makes the lock of the invention compact and universal. In addition, the lock has only a few components and all the components are simple in configuration, easy to be formed or machined and convenient to be assembled.

BRIEF DESCRIPTION OF THE DRAWINGS

The invention is now described in detail in the following by reference to the accompanying drawings in order for those who are skillful in this technical field to further understand the invention.

EMBODIMENTS

Figure 1:
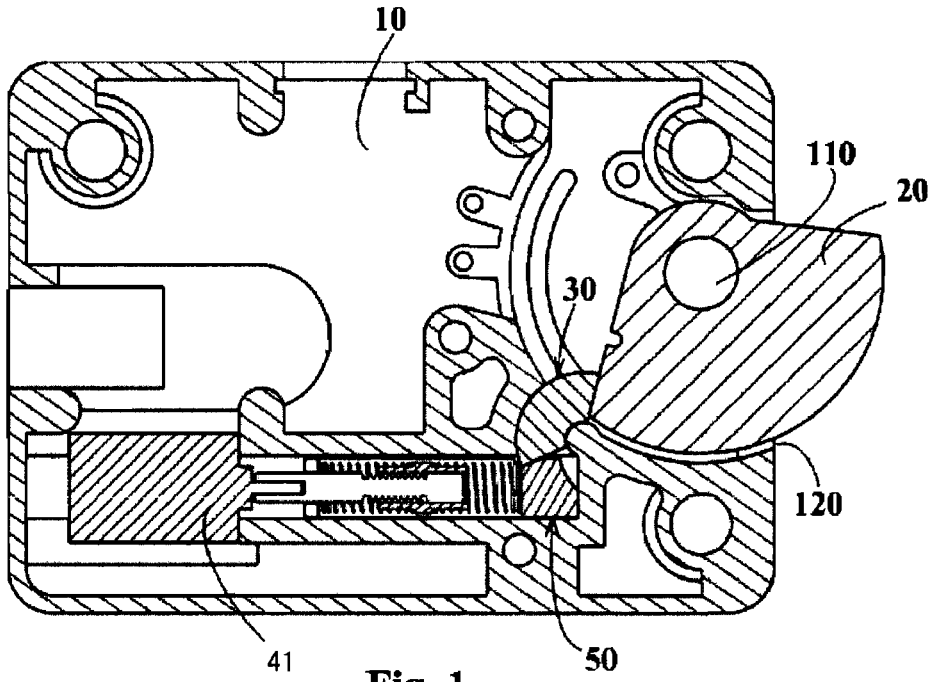
FIG. 1 is a schematic sectional view of a lock according to the present invention with the lock in its locked position.
Figure 2:
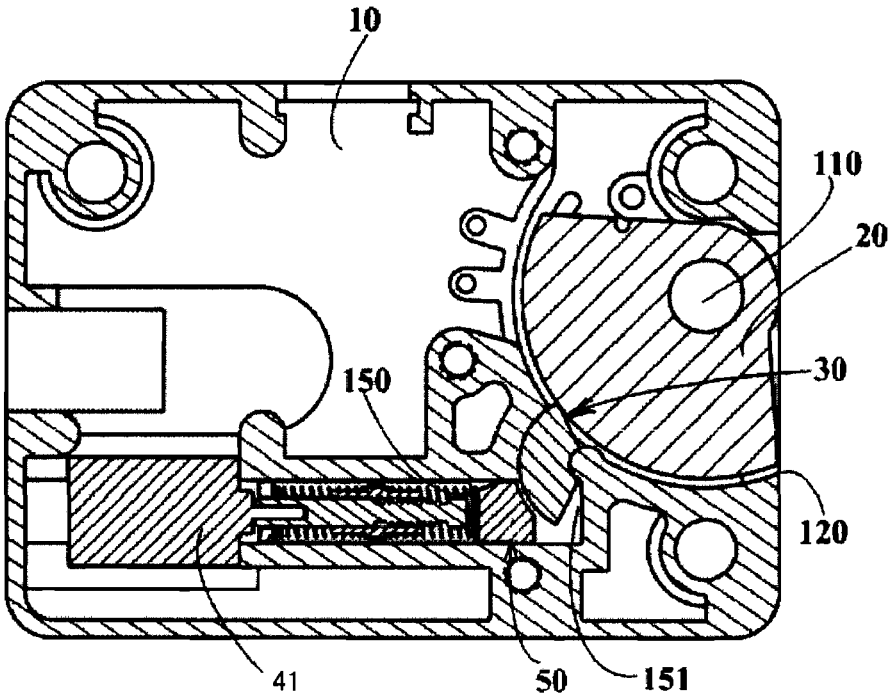
FIG. 2 is a schematic sectional view of the lock according to the present invention with the lock in its unlocked position.

As shown in FIG. 1 and FIG. 2, a sectorial bolt 20 is mounted, with a through hole 24 thereof, on a shaft 110 in a housing 10, and it can pivot about the shaft in a range of about 90 degree. The height of a stub 31 of a block member 30 and the height of a first sliding chute are substantially equal to the plate thickness of the bolt 20, and hence they move in the same plane.

Figure 3:
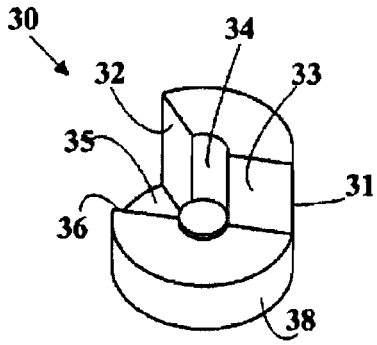
FIG. 3 is a schematic perspective view of a block member in the lock according to the present invention.
Figure 4:
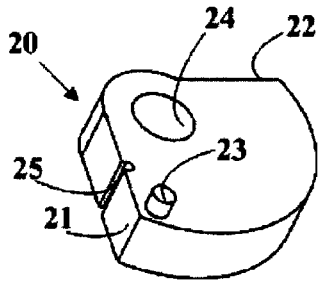
FIG. 4 is a schematic perspective view of a bolt in the lock according to the present invention.

Referring to FIG. 3 and FIG. 4, during assembling, the bolt 20 is first put in and then the stub 31 of the block member 30 is put in a first sliding chute 130 in the housing 10. The first sliding chute 130 is formed by a convex semi-cylindrical surface 131 provided in the housing 10 and an opposite concave partially-cylindrical surface 132, the distance between the two surfaces is just equal to the radial thickness of the sectorial portion of the stub 31 of the block member 30, however, with a suitable clearance for a slidable fit between them. After the block member 30 is assembled in position, the cylindrical portion 38 thereof covers on the bolt 20. In the locked position, a cylindrical protuberance 23 for returning is located in a recess 35 formed in the block member 30.

When the bolt 20 is in the locked position, i.e., when a follower 50 of the actuator assembly 40 is in its extended position, a head 59 of the follower 50 is positioned at the top of a second sliding chute 150, restricting the stub 31 of block member 30 from turning in an anticlockwise direction in the figure. The bolt 20 is locked up, because a first side 32 of the block member 30 acts on a first side 21 of the bolt 20.

In the condition that the bolt 20 is locked up, if the lock is to be illegally and forcibly unlocked, that is, a strong external force is exerted on the doorknob or pull handle, the force is first transferred to a second side 22 of the bolt 20, and then to the stub 31 of the block member 30 via the first side 21 of the bolt 20, and further to the head 59 of the follower 50, and finally to the lock body via the second sliding chute 150 of the housing 10. It should be noted that the force is transferred in a surface contact or in a manner of plane-to-plane contact, furthermore, the external force is divided by the solid head 59 of the follower 50 into two components, and one of which is perpendicular to a second side 52 of the head and the other is perpendicular to a third side 53 of the head, thereby, stress concentration is reduced. Further, an elastic transmission coupling is provided between the follower 50 and the actuator assembly 40, and only the head 59 of the follower 50 bears the force while the leading screw does not bear the force or bears only a very small force, which can protect the actuator assembly 40 from being directly exerted by the external force and so from being damaged, as such, a capability of the whole lock to withstand a illegally and forcibly unlocking is improved.

Figure 5:
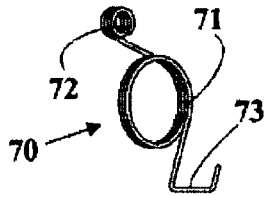
FIG. 5 is a schematic perspective view of a biasing spring in the lock according to the present invention.
Figure 6:
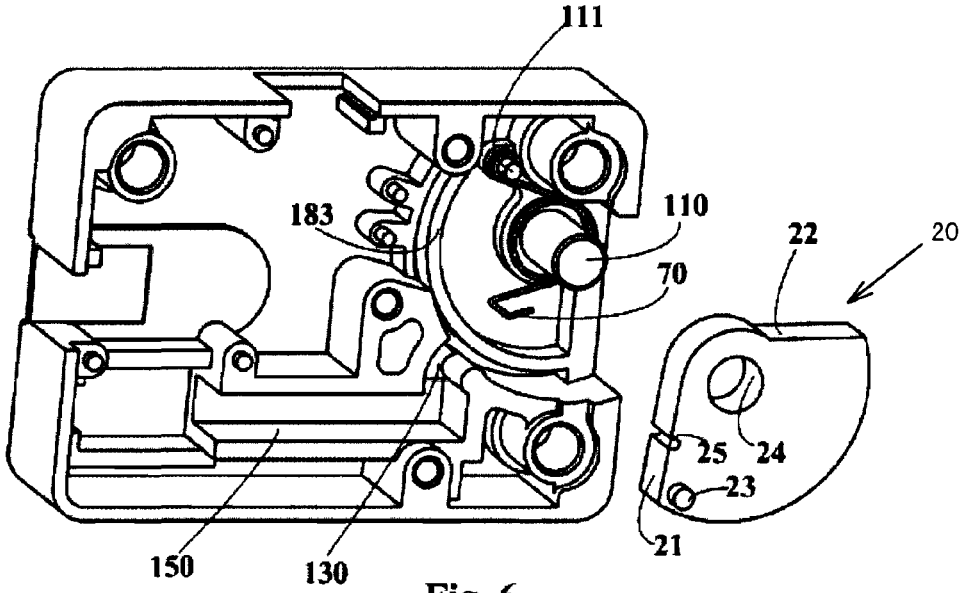
FIG. 6 is a schematic perspective view showing an assembling relation among the bolt, biasing spring and housing.

FIG. 5 shows a configuration of a return spring 70, and FIG. 6 shows the assemble relation between the return spring 70 and the bolt 20 when they are mounted in the housing 10. The spring is a torsion biasing spring, in its operating condition, with its big turns 71 being placed over the pivot 110 and with its small turns 72 placed over a pivot 111 in the housing 10, and with its free end 73 being caught in a notch 25 formed in the bolt 20. In its operating condition, the spring exerts a biasing force upon the bolt 20 so as to bias the same in the anticlockwise direction in FIG. 1.

The unlocking and resetting process of the lock is now described as follows.

A control device of a safe when receiving a correct command for unlocking the lock from an input device such as a keyboard, magnetic card or fingerprint scanner and the like, controls the actuator assembly 40 to operate so as to move the follower 50, and thereby releasing the bolt 20 from being locked-up. In the embodiment, when the command for unlocking is received, a motor 41 of the actuator assembly 40 is switched on a positive electric current, and is made to rotate in a positive direction so as to move the follower 50 in a retraction direction, which makes the second sliding chute 150 be vacant and makes the stub 31 partially into the space 151. At this time, if there is an external force which tries to turn the doorknob or pull handle of the door, under the force, the bolt 20 overcomes the biasing force of the return spring 70 and turns in a clockwise direction in FIG. 2. Meanwhile, the first side 21 of the bolt 20 exerts a force upon the first side 32 of the stub 31 so as to push the latter to rotate through an angle in the anticlockwise direction in FIG. 2 and to make a portion of the stub 31 go into the vacant space of the second sliding chute 150, and thus, the bolt 20 can be turned through about 90 degree and to its unlocked position. At the beginning of the above process, the cylindrical protuberance 23 on the bolt 20 is positioned in the recess 35 in the block member 30, whereas when the bolt 20 has been turned to its unlocked position and the stub 31 has been turned through a corresponding angle, the cylindrical protuberance 23 on the bolt 20 is disengaged from the recess 35. However, when the bolt 20 is in its unlocked position, the opened side of the sectorial recess 35 is just aligned with a path through which the cylindrical protuberance 23 must move during the bolt 20 being reset.

At the moment the external force is withdrawn from the doorknob or pull handle of the door, the return spring 70 biases the bolt 20 to reset from its unlocked position to its locked position, and the bolt 20 is turned in the anticlockwise direction in FIG. 2, meanwhile, the cylindrical protuberance 23 on the bolt 20 goes into the recess 35 through the opened side of the recess 35 in the block member 30 and exerts a force upon the other flat side 36 of the recess 35 so as to drive the block member 30 to turn reversely through an angle which is the same it is turned during unlocking the lock and to make the space 151 of the second sliding chute 150, which was occupied by the stub 31 when the lock was unlocked, vacant. After the bolt 20 and block member 30 has been reset, the control device makes the motor 41 to be switched on a negative electric current so as to make it rotate reversely and to move the follower 50 in the extending direction until the solid head 59 of the follower 50 goes completely into the space 151 of the second sliding chute 150, the block member 30 is locked up again and so is the bolt 20.

Figure 7:
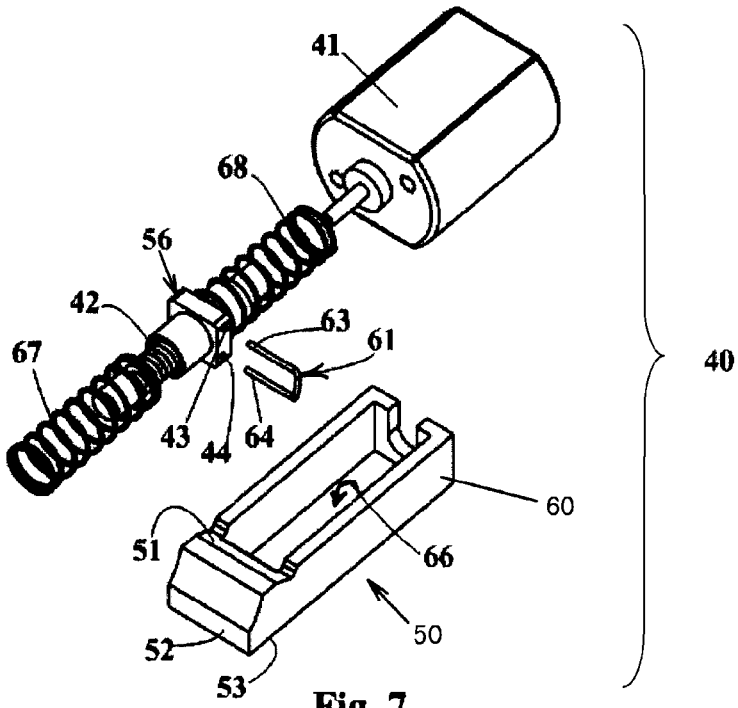
FIG. 7 is a schematic perspective view of an actuator assembly in the lock according to the present invention.

FIG. 7 shows an actuator assembly which can be used for the lock with a swing bolt according to the present invention or for other safes. The motor 41 in the assembly is a DC motor available in the market. The motor is mounted in a cavity formed in the housing 10 with its shaft being inserted into a hole 45 in the leading screw 42. The coupling between the motor shaft and the leading screw can be a simple interference fit because they requires to transfer only a small toque. The outside walls of the box 60 is slidably fitted in the second sliding chute 150, and the inner walls of the box 60 is slidably fitted with the outside surface of the sleeve 56. When the sleeve 56 is moved linearly, it can push the box 60 to move linearly by acting on two compression springs 67 and 68 which are placed over the sleeve 56. An advantageous function of such a configuration is to absorb shock and vibration and to maintain a contact pressure between the sleeve 56 and the box 60 so as to prevent them from misaligning with each other, and to prevent the sleeve 56 from jumping out of the box 60 while an impactive outside force is exerted upon the lock body.

Figure 8:
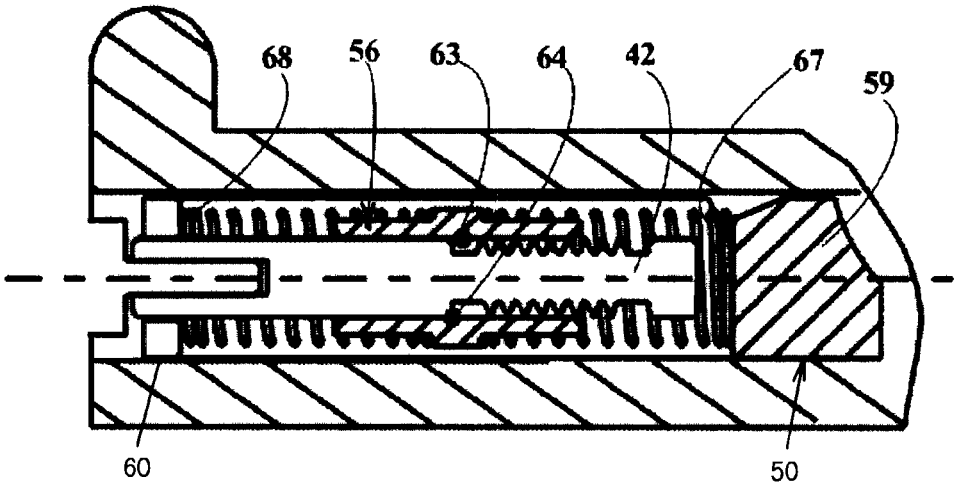
FIG. 8 is a schematic sectional view of a portion of the actuator assembly according to the present invention.
Figure 9:
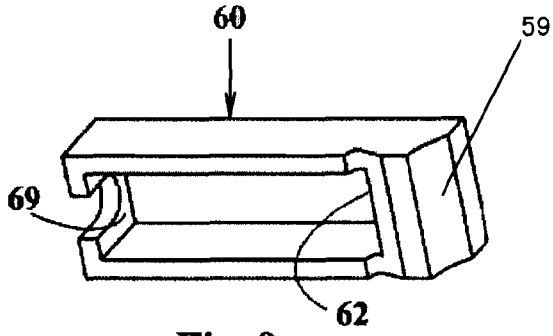
FIG. 9 is a schematic perspective view of a box of the actuator assembly according to the present invention.
Figure 10:
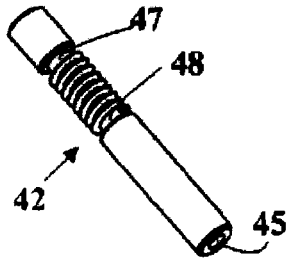
FIG. 10 is a schematic perspective view of a leading screw in the actuator assembly according to the present invention.
Figure 11:
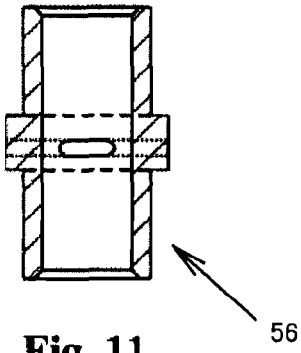
FIG. 11 is a schematic sectional view of a sleeve in the actuator assembly according to the present invention.
Figure 12:
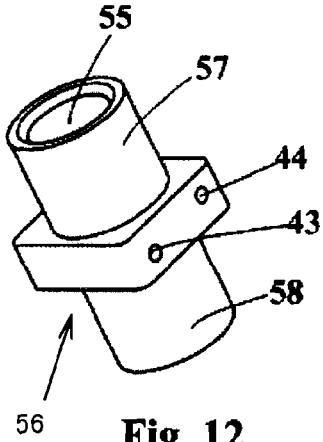
FIG. 12 is a perspective view of the sleeve according to the present invention.

Another advantageous function of the configuration with the two springs is to provide a guide for a clip 61 to transit from extreme positions (i.e., the full-extended position and the full-retracted position) to a position where it is engaged with the threads of the leading screw 42. As shown in FIG. 8 and FIG. 10, on the leading screw 42 is provided with two guiding grooves 47 and 48. When the two legs 63 and 64 of the clip 61 are located in the guiding grooves 47 and 48, the follower 50 is just located at the above-said extreme positions. No matter whether the bolt 20 is turned from the locked position to the unlocked position or from the unlocked position to the locked position, the two legs 63 and 64 of the clip 61 will be transited from the guiding grooves 47 and 48 to a position where they are engaged with the threads of the leading screw 42. One of the necessary conditions for transiting to the engagement position is to exert an axial force upon the two legs 63 and 64 of the clip 61, the provision of the two spring 67 and 68 just meets this requirement. As can be seen from FIG. 7, FIG. 9 and FIG. 12, the two springs 67 and 68 are placed over cylindrical portions 57 and 58 of the sleeve 56 respectively and limited by the end faces of a hexahedron portion, and the other ends of the two spring 67 and 68 are limited respectively by the end walls 62 and 69 of the box 60. Thus, no matter at any position, the two springs 67 and 68 maintain to exert an axial force upon the sleeve 56 or the two legs 63 and 64 of the clip 61. In other words, a conventional combination of a screw and a nut has been modified into the combination of the two legs 63 and 64 of the clip 61 and the threads of the leading screw 42. A significant technical effect of this modification is to avoid a jam between a screw and a nut so as to protect the motor 41 from being damaged by being forcibly stopped. A state of being forcibly stopped may be caused by 1) a jam between a screw and a nut due to a mis-engagement or angle difference, and 2) by other mechanical troubles, for example, if the block member 30 can not be fully retracted because of some troubles, the follower 50 can not move in the extending direction. However, in the technical solution of the present invention, there exists a clearance between the two legs 63 and 64 of the clip 61 and the corresponding holes 43 and 44 as well as between the legs and the threads of the leading screw 42, and the two legs 63 and 64 are elastic and the engagement between them and the threads of the leading screw 42 is flexible. Even if a jam or some other troubles occur, there will be a slippage between the two legs 63 and 64 of the clip 61 and the threads of the leading screw 42, i.e., the leading screw 42 can rotate normally, but the clip 61 and the sleeve 56 will not move linearly. Accordingly, it is possible to protect the motor 41 from being damaged by being forcibly stopped.

Further, still another advantageous function of the two springs is to solve the problem of locking or unlocking when an external force is applied to the bolt. In particular, when the bolt 20 is at the locked position, if an external force is applied to the bolt 20, the block member 30 will block the follower 50. At this time, if the control device supplies an "unlock" signal to the motor 41 to make it rotate and thereby retracting the follower 50, the sleeve 56 will compress the spring 68. When the external force is removed, the spring 68 is released, thereby pushing the box 60 to the unlocked position. When the bolt 20 is at the unlocked position and there is an external force preventing the return spring 70 from resetting the bolt 20, the block member 30 occupies the space of the follower 50. At this time, if the control device supplies a "lock" signal to the motor 41 to makes it rotate and thereby advancing the follower 50, the motor 41 keeps rotating and compresses the spring 67 with the sleeve 56. When the external force is removed, the return spring 70 will make the block member 30 out of the second sliding chute, and the spring 67 is released to push the box 60 to the locked position, thereby locking the bolt 20.

Figure 13:
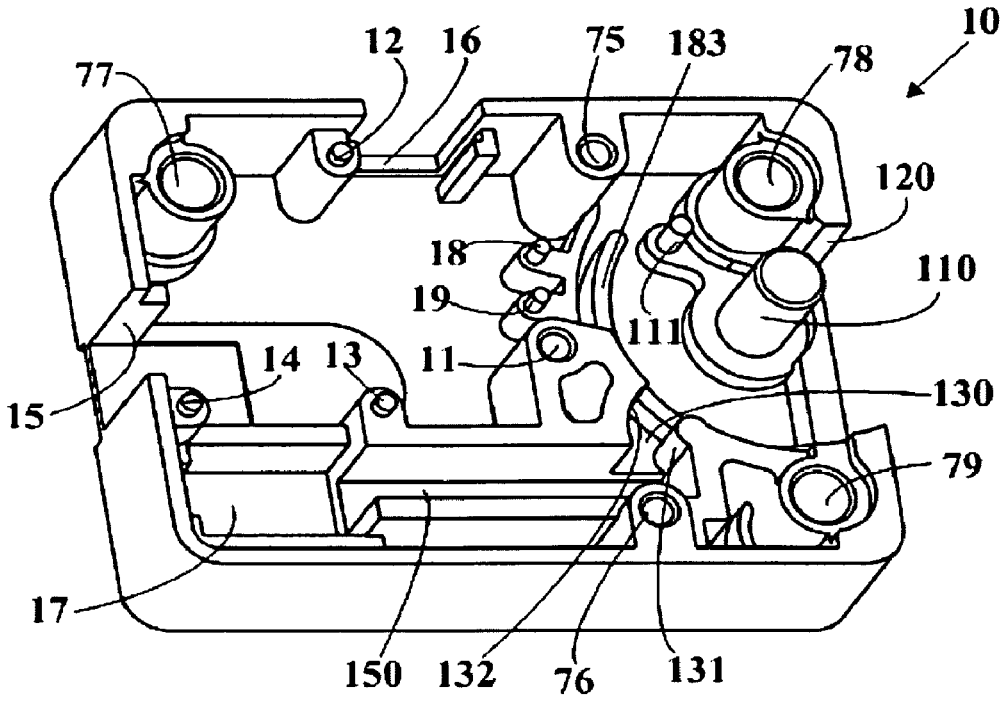
FIG. 13 is a schematic perspective view of the housing according to the present invention.
Figure 14:
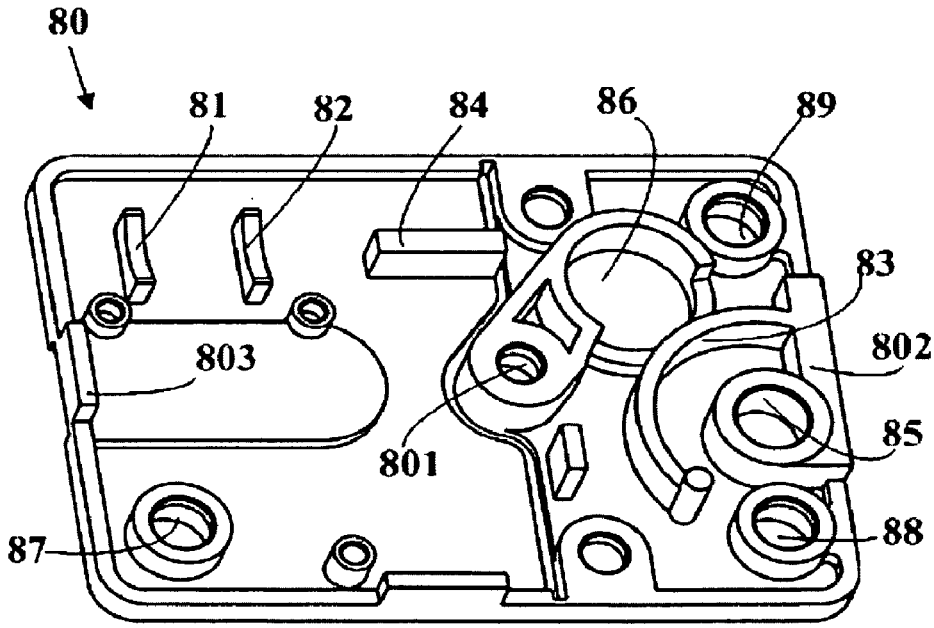
FIG. 14 is a schematic perspective view of a cover according to the present invention.

FIG. 13 and FIG. 14 show the structure of the housing 10 and the cover 80 of the present invention. Two cylindrical pins 18 and 19 formed integrally with the housing 10 are used to fix a sensitive switch. The sensitive switch is used to detect whether the bolt 20 is at the unlocked position or at the locked position. During the process that the bolt 20 is moved from the locked position to the unlocked position or moved reversely, the switch is touched by the bolt 20 and generates an electric signal. In the housing 10, there are also integrally provided with three pins 12, 13 and 14 for mounting a PCB of the control device and notches 15 and 16 for mounting connectors.

In the housing 10 and the cover 80, there are provided respectively a threaded hole 11 and a through hole 801 for using a screw to fasten them together.

In addition, on the housing 10, there is formed an opening 120 for allowing the bolt 20 to turn in or out. The largest dimension of the opening 120 is less than the radius of the bolt 20 thereby the bolt 20 can not be removed horizontally through the opening 120.

Considering the integrity of the whole structure for assembling the housing 10 and the cover 80, the following structures are provided thereon.

On the housing 10 are formed notches 15 and 120, correspondingly, on the cover 80 are formed complementary projections 803 and 802. They will create a mortise/tenon joint between the housing 10 and the cover 80 so as to firmly assemble them together.

On the cover 80 is formed a cylindrical chamber 86 which is used, as a boss hole, for the cylindrical portion 38 of the block member 30 to be inserted into it with a slidable fit therebetween.

On the cover 80 is formed a cylindrical chamber 85 which is used, as a boss hole, for the shaft 110 formed on the housing 10 to be inserted into it with a slidable fit therebetween.

On the cover 80 is formed a guide rail 83 which is engaged with the guiding rail 183 formed on the housing 10 for guiding the bolt 20 to turn smoothly.

On the cover 80 are formed two ribs 81 and 82 for fixing the motor 41.

On the cover 80, in a location corresponding to the second sliding chute 150 in the housing 10, is formed a rib 84 for restricting the follower 50.

On the housing 10 are also formed holes 75 and 76 for mounting bolts to protect the lock from being opened violently by a picklock. On the housing 10 and the cover 80, there are provided with mounting holes 77, 78, 79 and 87, 88, 89 respectively for mounting the lock on a door. By the way, for meeting different mounting requirements, the above mounting holes are preferably provided with the same counterbore. Thus, no matter the lock is mounted onto a door with its front side or back side against the door, the configuration above can always meet the requirements.

While the present invention has been described in detail in conjunction with the preferred embodiment, it should be understood that those who are skillful in the art can make various equivalent changes and modifications without departing from the scope and the spirit of this invention. Consequently, the embodiment as described is intended to be exemplary but not to limit the invention. All variants and modifications without departing from the scope and the spirit of the invention should befallen in the scope of the invention.

The invention claimed is:

1. An actuator assembly for a lock with a swing bolt, said actuator assembly comprising:

a motor;

a leading screw connected coaxially to the motor;

a sleeve engaged with the leading screw and moving linearly as the leading screw is rotated, the sleeve having an internal hole;

a clip having two legs for engaging with the leading screw, the clip being mounted to the sleeve; and a follower moving linearly by the linear movement of the sleeve, wherein the sleeve further includes a pair of holes perpendicularly to the internal hole to allow the two legs of the clip to insert thereinto, such that when the leading screw is rotated, the two legs engage with corresponding threads of the leading screw to cause the sleeve to move linearly relative to the leading screw and thereby causing the follower to move linearly relative to the leading screw along with the sleeve, and wherein the two legs of the clip engage opposite sides of the leading screw.

2. The actuator assembly of claim 1, wherein the follower comprises a box having a first internal end face, a second internal end face, and an internal space defined therebetween allowing the sleeve to be contained therein, and the box also having a head positioned at an end of thereof.

3. The actuator assembly of claim 2, wherein the sleeve includes two extended cylindrical end portions and a central projection, over the extended cylindrical end portions of the sleeve are placed respectively a first spring and a second spring, one end of the first spring is abutted against the first internal end face of the box, and the other end of the first spring is abutted against the central projection of the sleeve, one end of the second spring is abutted against the second internal end face of the box, and the other end of the second spring is also abutted against the central projection of the sleeve.

4. An actuator assembly for a lock with a swing bolt, said actuator assembly comprising:

a motor;

a leading screw connected coaxially to the motor;

a sleeve engaged with the leading screw and moving linearly as the leading screw is rotated, the sleeve having an internal hole;

a clip having two legs for engaging with the leading screw, the clip being mounted to the sleeve; and a follower moving linearly by the linear movement of the sleeve, wherein the sleeve further includes a pair of holes perpendicularly to the internal hole to allow the two legs of the clip to insert thereinto, such that when the leading screw is rotated, the two legs engage with corresponding threads of the leading screw to cause the sleeve to move linearly relative to the leading screw and thereby causing the follower to move linearly relative to the leading screw along with the sleeve, wherein the follower comprises a box having a first internal end face, a second internal end face, and an internal space defined therebetween allowing the sleeve to be contained therein, and the box also having a head positioned at an end of thereof, wherein the sleeve includes two extended cylindrical end portions and a central projection, over the extended cylindrical end portions of the sleeve are placed respectively a first spring and a second spring, one end of the first spring is abutted against the first internal end face of the box, and the other end of the first spring is abutted against the central projection of the sleeve, one end of the second spring is abutted against the second internal end face of the box, and the other end of the second spring is also abutted against the central projection of the sleeve, and wherein the two legs of the clip engage opposite sides of the leading screw.

* * * * *